US009668517B2

(12) United States Patent
Liu

(10) Patent No.: US 9,668,517 B2
(45) Date of Patent: Jun. 6, 2017

(54) ELECTRONIC CIGARETTE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 780 days.

(21) Appl. No.: 14/031,415

(22) Filed: Sep. 19, 2013

(65) Prior Publication Data

US 2015/0027463 A1 Jan. 29, 2015

(30) Foreign Application Priority Data

Jul. 25, 2013 (CN) ..... 2013 2 0449480 U

(51) Int. Cl.
*A24F 47/00* (2006.01)

(52) U.S. Cl.
CPC ..... *A24F 47/008* (2013.01)

(58) Field of Classification Search
CPC ..... A24F 47/002; A24F 47/004; A24F 47/008
USPC ..... 128/200; 131/329
See application file for complete search history.

(56) References Cited

U.S. PATENT DOCUMENTS

2011/0304282 A1* 12/2011 Li ..... A24F 47/008 315/362

* cited by examiner

*Primary Examiner* — Joseph S Del Sole
*Assistant Examiner* — Mohamed K Ahmed Ali
(74) *Attorney, Agent, or Firm* — Tim Tingkang Xia, Esq.; Locke Lord LLP

(57) ABSTRACT

An electronic cigarette is provided, and the electronic cigarette comprises an outer sleeve, a battery and a controlling module both mounted inside the outer sleeve; the electronic cigarette further comprises a mounting seat which the controlling module is mounted on, and an electrode terminal mounted on the mounting seat and electrically connected to the controlling module; an end of the electrode terminal, aloof from the controlling module, is connected to a conductive wire by soldering. By implementing the electronic cigarette in the present application, the following advantages can be achieved. The electronic cigarette adopts that the conductive wire is soldered on the first electrode terminal, the second electrode terminal or the third electrode terminal, so that the conductive wire is electrically connected to the controlling module, and soldering operation can be easily achieved, which can improve production efficiency of the electronic cigarettes and decrease product defective rate.

11 Claims, 8 Drawing Sheets

ELECTRONIC CIGARETTE

CROSS-REFERENCE TO RELATED APPLICATIONS

This non-provisional application claims priorities under 35 U.S.C. §119(a) on Patent Application No. 201320449480.0 filed in P.R. China on Jul. 25, 2013, the entire contents of which are hereby incorporated by reference.

FIELD OF THE INVENTION

The present application relates to the field of consumer electronic products, and more particularly relates to an electronic cigarette.

BACKGROUND OF THE INVENTION

As shown in FIG. 1, the existing electronic cigarette comprises an outer sleeve 100, a battery assembly and an atomizer assembly both mounted inside the outer sleeve 100. The battery assembly includes a battery 200, a controlling module 300, a first conductive wire 400, a second conductive wire 500 and a third conductive wire 600, above three conductive wires are respectively soldered on the controlling module 300. The controlling module 300 integrates an air flow sensor and a control circuit and so on. The first conductive wire 400, the second conductive wire 500 and the third conductive wire 600 are respectively electrically connected to two electrodes of the battery 200 and the two electrodes of the atomizer assembly. When the electronic cigarette is smoked, the battery 200 controlled by the controlling module 300 supplies electric power to the atomizer assembly to drive the atomizer assembly to generate smoke. When a structure that the first conductive wire 400, the second conductive wire 500 and the third conductive wire 600 are respectively connected to the controlling module 300 by welding is adopted, a welding operation is not easily achieved, which leads to low production efficiency and high product defective rate of electronic cigarettes.

SUMMARY OF THE INVENTION

The objective of the present application is to provide an electronic cigarette, of which an operation that a conductive wire is electrically connected to a controlling module can be easily achieved, aiming at the defect that the operation that the conductive wire is soldered on the controlling module can not be easily achieved.

The technical solutions of the present application for solving the technical problems are as follows.

In one aspect, an electronic cigarette is provided, and the electronic cigarette comprises an outer sleeve, a battery and a controlling module both mounted inside the outer sleeve; the electronic cigarette further comprises a mounting seat which the controlling module is mounted on, and an electrode terminal mounted on the mounting seat and electrically connected to the controlling module; an end of the electrode terminal, aloof from the controlling module, is connected to a conductive wire by soldering.

In one embodiment, the electrode terminal is a third electrode terminal; the conductive wire is a third conductive wire; the electronic cigarette further comprises a first electrode connecting member and a second electronic connecting member both mounted on an end of the outer sleeve, and a first electrode terminal and a second electrode terminal respectively mounted on the mounting seat and electrically connected to the controlling module;

the controlling module, through detected airflow, is configured to control connection or disconnection between a first electrode of the battery and the first electrode connecting member or the second electrode connecting member.

The electronic cigarette further comprises a first conductive wire soldered on the end of the first electrode terminal far away from the controlling module, and a second conductive wire soldered on the end of the second electrode terminal aloof from the controlling module;

the battery further includes a battery body and a second electrode; the first electrode and the second electrode are respectively defined on two opposite end surfaces of the battery body;

herein, an end of the first conductive wire far away from the first electrode terminal is connected to the first electrode by soldering;

an end of the second conductive wire aloof from the second electrode terminal is respectively connected to the second electrode and the first electrode connecting member by soldering;

an end of the third conductive wire aloof from the third electrode terminal is connected to the second electrode connecting member by soldering.

In one embodiment, the battery further includes a battery body and a second electrode; both the first electrode and the second electrode extend from an end surface of the battery body aloof from the first electrode connecting member to a side abutting the mounting seat;

herein, the first electrode terminal and the first electrode abut against each other;

the second electrode terminal and the second electrode abut against each other; and both the second electrode terminal and the first electrode connecting member abut against an inner surface of the outer sleeve;

an end of the third conductive wire far away from the third electrode terminal is connected to the second electrode connecting member by soldering.

The first electrode terminal defines a first inserting cavity corresponding to the first electrode; the first electrode is inserted into the first inserting cavity;

the second electrode terminal defines a second inserting cavity corresponding to the second electrode; the second electrode is inserted into the second inserting cavity.

The second electrode terminal defines a resisting part protruding towards an inner surface of the outer sleeve; the resisting part and the inner surface of the outer sleeve abut against each other.

In one embodiment, the controlling module is detachably mounted on the mounting seat.

In one embodiment, the controlling module includes a first pin, a second pin and a third pin; the mounting seat defines a first inserting hole, a second inserting hole and a third inserting hole;

herein, both the first pin and the first electrode terminal are inserted into the first inserting hole; both the second pin and the second electrode terminal are inserted into the second inserting hole; both the third pin and the third electrode terminal are inserted into the third inserting hole.

An end of the first electrode terminal located inside the first inserting hole defines a first inserting recess; the first inserting recess and the first pin abut against each other;

an end of the second electrode terminal located inside the second inserting hole defines a second inserting recess; the second inserting recess and the second pin abut against each other;

an end of the third electrode terminal located inside the third inserting hole defines a third inserting recess; the third inserting recess and the third pin abut against each other.

In one embodiment, the electronic cigarette further comprises an insulating ring mounted between the first electrode connecting member and the second electrode connecting member and configured to achieve electrical insulation.

The electronic cigarette further comprises a lamp assembly; the lamp assembly is mounted on an end of the outer sleeve far away from the first electrode connecting member.

The outer sleeve includes an atomizing sleeve and a battery sleeve detachably connected to the atomizing sleeve; an atomizer assembly of the electronic cigarette is mounted inside the atomizing sleeve; the battery, the controlling module, the mounting seat, the first electrode terminal, the second electrode terminal, the third electrode terminal, the first electrode connecting member and the second electrode connecting member are all mounted inside the battery sleeve.

By implementing the electronic cigarette in the present application, the following advantages can be achieved. The electronic cigarette adopts that the conductive wire is soldered on the first electrode terminal, the second electrode terminal or the third electrode terminal of the mounting seat, so that the conductive wire is electrically connected to the controlling module. As the electrode terminals on the mounting seat are not limited by circuit structure, the distance between the electrode terminals can be designed to be wider, and soldering operation can be easily achieved, which can improve production efficiency of the electronic cigarettes and decrease product defective rate. Furthermore, it can cut down the number of soldering points and further improve the production efficiency of the electronic cigarettes that one selected from the first electrode terminal, the second electrode terminal and the third electrode terminal is connected to the conductive wire by soldering.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

To make the technical feature, objective and effect of the present application be understood more clearly, now the specific implementation of the present application is described in detail with reference to the accompanying drawings and embodiments.

Figure 1:
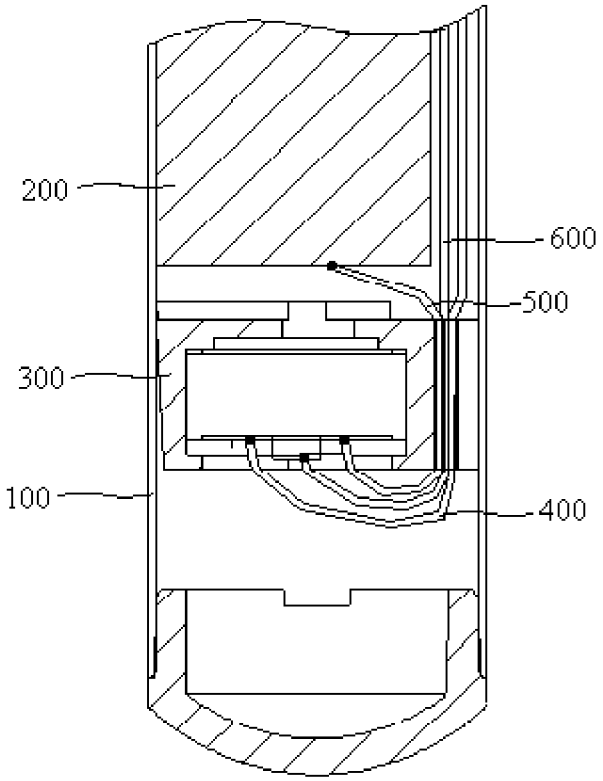
Fig. 1 (Prior Art)
FIG. 1 is a structural schematic view of an electronic cigarette in prior art.
Figure 2:
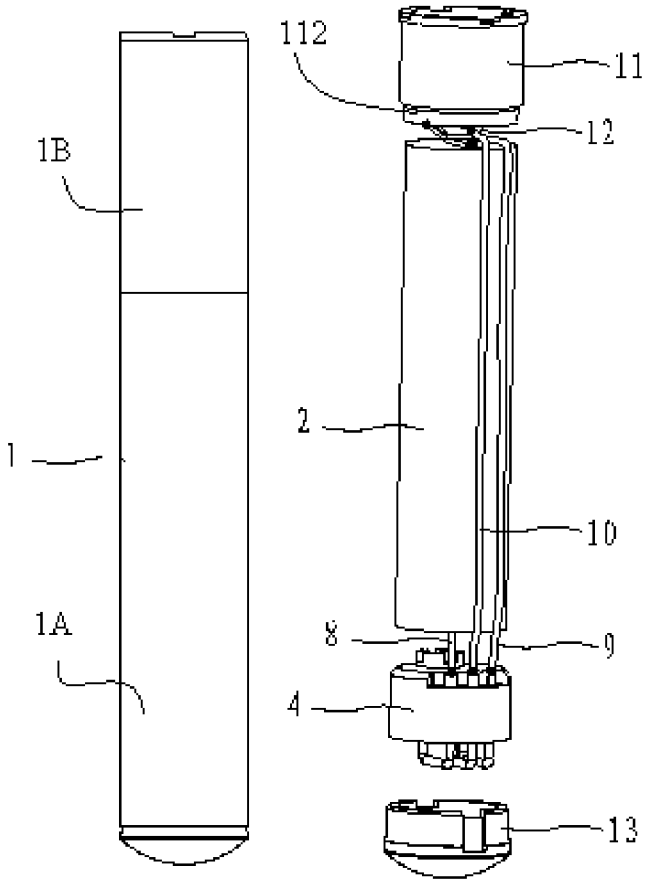
FIG. 2 is an exploded view of an electronic cigarette according to a first preferred embodiment of the present application.
Figure 4:
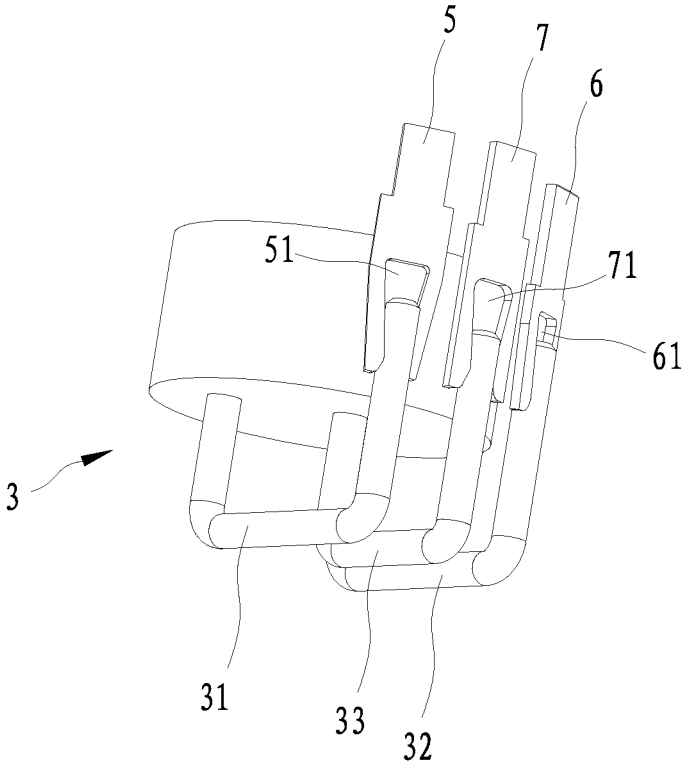
FIG. 4 is a schematic view that a controlling module is respectively connected to a first electrode terminal, a second electrode terminal and a third electrode terminal in the electronic cigarette shown in FIG. 2.

As shown in FIG. 2 and FIG. 4, a first preferred embodiment of the present application provides an electronic cigarette comprising an outer sleeve 1, a battery 2, a controlling module 3, a mounting seat 4, a first electrode terminal 5, a second electrode terminal 6, a third electrode terminal 7, a first conductive wire 8, a second conductive wire 9, a third conductive wire 10, a first electrode connecting member 11, a second electrode connecting member 12, a lamp assembly 13 and an insulating ring 112. The outer sleeve 1 is approximately a hollow cylindrical structure.

Figure 3:
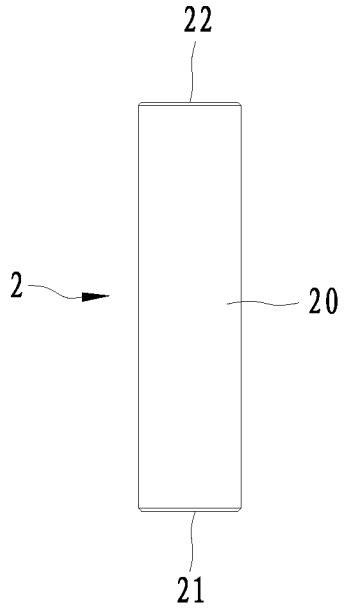
FIG. 3 is a structural schematic view of a battery of the electronic cigarette shown in FIG. 2.

As shown in FIG. 3, the battery 2 includes a battery body 20, a first electrode 21 and a second electrode 22. The first electrode 21 and the second electrode 22 are respectively disposed on two opposite end surfaces of the battery body 20. The battery 2 is mounted inside the outer sleeve 1 and can adopt common dry cell. In this embodiment, the first electrode 21 is positive electrode of the battery 2, and the second electrode 22 is negative electrode of the battery 2. In another embodiment of the present application, the first electrode 21 can be also negative electrode of the battery 2, and the second electrode 22 can be also positive electrode of the battery 2.

As shown in FIG. 4, FIG. 2 and FIG. 3, the controlling module 3 includes a first pin 31, a second pin 32 and a third pin 33. The controlling module 3 integrates an air flow sensor and a control circuit and so on, and is mounted inside the outer sleeve 1. In this embodiment, the first pin 31 and the second pin 32 are inputs of the controlling module 3, that is, the battery 2 supplies electric power to the controlling module 2 through the first pin 31 and the second pin 32; the third pin 33 is an output of controlling signals of the controlling module 3. Herein, the first pin 31 is electrically connected to the first electrode 21; the second pin 32 is electrically connected to the second electrode 22 and the first electrode connecting member 11; and the third pin 33 is electrically connected to the second electrode connecting member 12.

Figure 5:
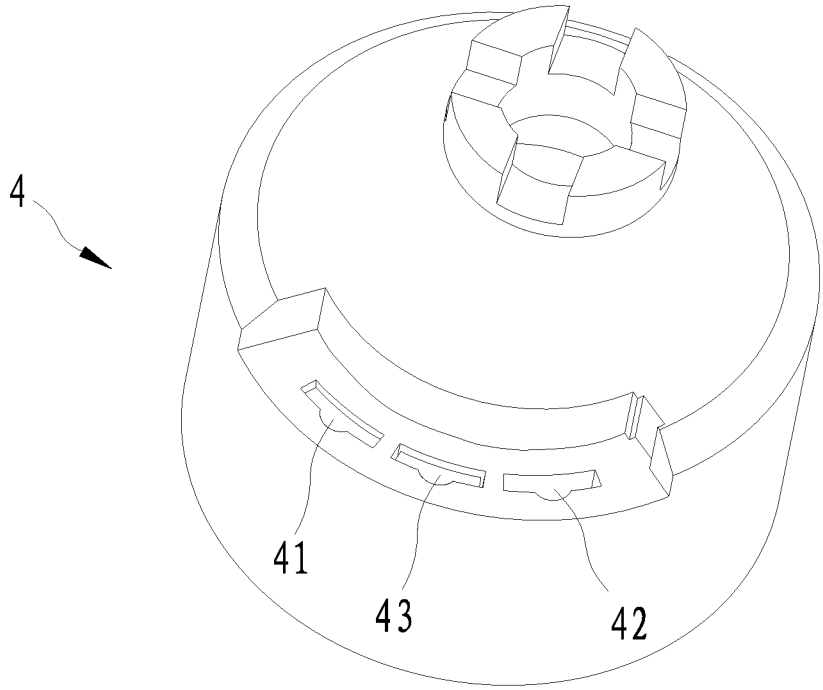
FIG. 5 is a structural schematic view of a mounting seat of the electronic cigarette shown in FIG. 2.

As shown in FIG. 5 and FIG. 4, the mounting seat 4 includes a first inserting hole 41, a second inserting hole 42, and a third inserting hole 43. The first inserting hole 41, the second inserting hole 42 and the third inserting hole 43 are approximately a square through-hole structure. The mounting seat 4 is made of electrical insulating material, and the controlling module 3 is mounted on the mounting seat 4. Both the first pin 31 and the first electrode terminal 5 are inserted inside the first inserting hole 41 to achieve electrical connection between the first pin 31 and the first electrode terminal 5. Both the second pin 32 and the second electrode terminal 6 are inserted inside the second inserting hole 42 to achieve electrical connection between the second pin 32 and the second electrode terminal 6. Both the third pin 33 and the third electrode terminal 7 are inserted inside the third inserting hole 43 to achieve electrical connection between the third pin 33 and the third electrode terminal 7.

As shown in FIG. 4 and FIG. 5, the first electrode terminal 5 is approximately a straight structure, and includes a first inserting recess 51; and the first inserting recess 51 is defined on an end of the first electrode terminal 5 located inside the first inserting hole 41. The first inserting recess 51 and the first pin 31 abut against each other to achieve their electrical connection. The second electrode terminal 6 is approximately a straight structure, and includes a second inserting recess 61; and the second inserting recess 61 is defined on an end of the second electrode terminal 6 located inside the second inserting hole 42. The second inserting recess 61 and the second pin 32 abut against each other to achieve their electrical connection. The third electrode terminal 7 is approximately a straight structure, and includes a third inserting recess 71; the third inserting recess 71 is defined on an end of the third electrode terminal 7 located inside the third inserting hole 43. The third inserting recess 71 and the third pin 33 abut against each other to achieve their electrical connection.

As shown in FIG. 2, FIG. 3 and FIG. 4, one end of the first conductive wire 8 is connected to the first electrode terminal 5 by soldering, and the other end of the first conductive wire 8 is connected to the first electrode 21 by soldering, which lead to electrical connection between the first pin 31 and the first electrode 21. One end of the second conductive wire 9 is connected to the second electrode terminal 6 by soldering, and the other end of the second conductive wire 9 is respectively connected to the second electrode 22 and the first electrode connecting member 11 by soldering, so that the second pin 32 is electrically connected to the second electrode 22 and the first electrode connecting member 11. One end of the third conductive wire 10 is connected to the third electrode terminal 7 by soldering, and the other end of the third conductive wire 10 is soldered on the electrode connecting member 12, which leads to electrical connection between the third pin 33 and the second electrode connecting member 12. The first conductive wire 8, the second conductive wire 9 and the third conductive wire 10 are respectively correspondingly connected to the first electrode terminal 5, the second electrode terminal 6 and the third electrode terminal 7 by soldering, which leads to electrical connection between each conductive wire and the controlling module 3. Comparing above-described soldering way with directly connecting each conductive wire to the controlling module 3 by soldering, the electrode terminal on the mounting seat is not limited by circuit structure, and the distance between the electrode terminals can be designed to be wider, so that soldering operation can be easily achieved, production efficiency of the electronic cigarettes can be improved, and product defective rate can be decreased.

As shown in FIG. 2, the first electrode connecting member 11, the second electrode connecting member 12 and the insulating ring 112 are all mounted on an end of the outer sleeve 1. The first electrode connecting member 11 and the second electrode connecting member 12 are respectively connected to two electrodes (not shown) of an atomizer assembly (not shown), which is configured to supply electric power to the atomizer assembly for working. The insulating ring 112 is mounted between the first electrode connecting member 11 and the second electrode connecting member 12 to achieve electrical insulation.

As shown in FIG. 2 and FIG. 4, a lamp assembly 13 is mounted on an end of the outer sleeve 1 far away from the first electrode connecting member 11; and the lamp assembly 13 is electrically connected to the controlling module 3. When the electronic cigarette is working, the controlling module 3 drives the lamp assembly 13 to indicate that the electronic cigarette is working.

As shown in FIG. 2 to FIG. 5, the assembly process is as follows. At first respectively connecting the first conductive wire 8 to the first electrode terminal 5 and the first electrode 21 by soldering, respectively connecting the second conductive wire 9 to the second electrode terminal 6, the second electrode 22 and the first electrode connecting member 11 by soldering, and respectively connecting the third conductive wire 10 to the third electrode terminal 7 and the second electrode connecting member 12 by soldering; then, respectively inserting the first pin 31 and the first electrode terminal 5 into the first inserting hole 41, respectively inserting the second pin 32 and the second electrode terminal 6 into the second inserting hole 42, and respectively inserting the third pin 33 and the third electrode terminal 7 into the third inserting hole 43; at last mounting above-described connected structures inside the outer sleeve 1, and knotting the lamp assembly 13 and an end of the outer sleeve 1 together.

Figure 6:
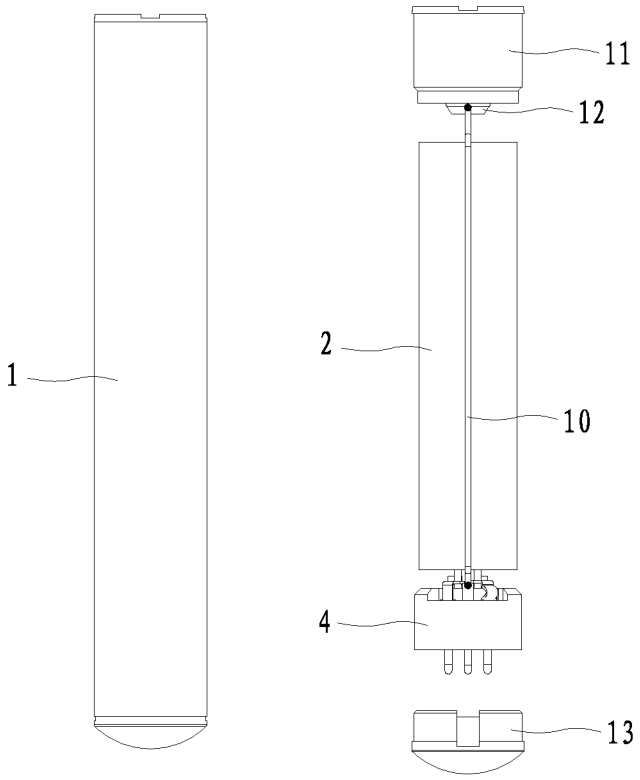
FIG. 6 is an exploded view of an electronic cigarette according to a second preferred embodiment of the present application.

As shown in FIG. 6, a second preferred embodiment of the present application provides an electronic cigarette; and the differences between the second preferred embodiment and the first preferred embodiment are structures of an inner surface of the outer sleeve 1, the battery 2, electrical connection between the first electrode terminal 5 and the first electrode 21, and electrical connection between the second electrode terminal 6 and the second electrode 22 or the first electrode connecting member 11. In this embodiment, the inner surface of the outer sleeve 1 is made of conductive material.

Figure 7:
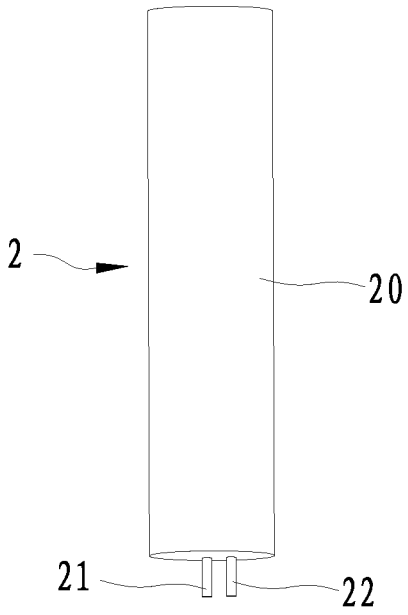
FIG. 7 is a structural schematic view of a battery in the electronic cigarette shown in FIG. 6.

As shown in FIG. 7, the first electrode 21 and the second electrode 22 of the battery 2 is disposed on the same end surface of the battery body 20 aloof from the first electrode connecting member 11. The first electrode 21 and the second electrode 22 are approximately a straight structure, and both the first electrode 21 and the second electrode 22 extend from this end surface to a side abutting the mounting seat 4.

Figure 8:
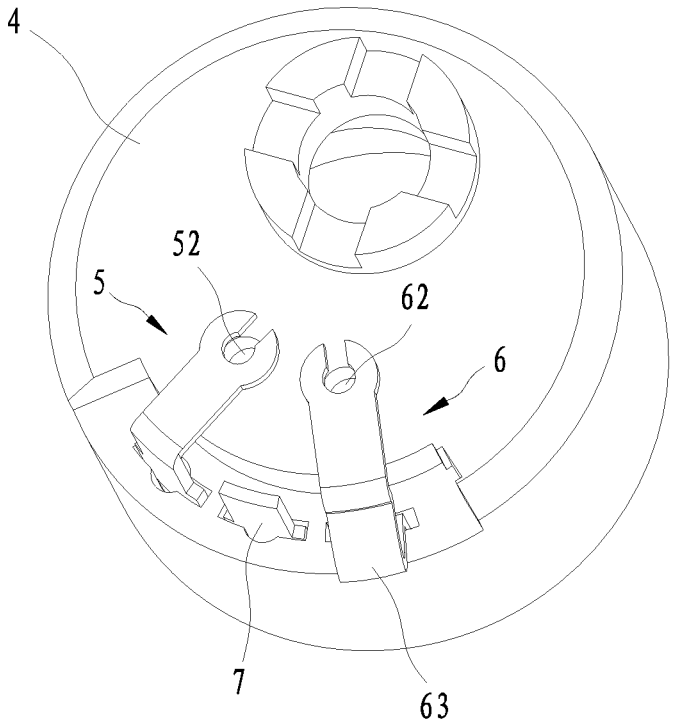
FIG. 8 is a schematic view that a controlling module is respectively connected to a first electrode terminal, a second electrode terminal and a third electrode terminal in the electronic cigarette shown in FIG. 6.

As shown in FIG. 8, the first electrode terminal 5 further includes a first inserting cavity 52. The first electrode terminal 5 is approximately an L-shaped structure; and the first inserting cavity 52 corresponds to the first electrode 21, and the first electrode 21 is disposed inside the first inserting cavity 52, which leads to their electrical connection. The second electrode terminal 6 further includes a second inserting cavity 62 and a resisting part 63. The second electrode terminal 6 is approximately an L-shaped structure; and the second inserting cavity 62 corresponds to the second electrode 22, and the second electrode 22 is disposed inside the second inserting cavity 62, which leads to their electrical connection. The resisting part 63 protrudes towards and abuts against an inner surface of the outer sleeve 1. In this embodiment, the first electrode connecting member 11 and the inner surface of the outer sleeve 1 abut against each other, and the inner surface of the outer sleeve 1 is made of conductive material, so that electrical connection between the first electrode connecting member 11 and the second electrode 22 can be achieved.

As shown in FIG. 6 to FIG. 8, the assembly process is as follows. At first respectively connecting the third conductive wire 10 to the third electrode terminal 7 and the second electrode connecting member 12 by soldering; then respectively inserting the first pin 31 and the first electrode terminal 5 into the first inserting hole 41, and inserting the first electrode 21 into the first inserting cavity 52; respectively inserting the second pin 32 and the second electrode terminal 6 into the second inserting hole 42, and inserting the second electrode 22 into the second inserting cavity 62; and respectively inserting the third pin 33 and the third electrode terminal 7 into the third inserting hole 43; at last mounting above-described connected structures inside the outer sleeve 1, and knotting the lamp assembly 13 and an end of the outer sleeve 1 together.

Comparing this embodiment and the first embodiment, structures of the first conductive wire 8 and the second conductive wire 9 are left out, which decreases the number of soldering points and further improves production efficiency of the electronic cigarettes.

Another preferred embodiment of the present application provides an electronic cigarette; and the differences between this embodiment, and the first embodiment and the second embodiment is a structure of the outer sleeve 1. In this embodiment, the outer sleeve 1 includes an atomizing sleeve 1B and a battery sleeve 1A detachably connected to the atomizing sleeve 1B. The atomizer assembly is mounted inside the atomizing sleeve 1B. The battery 2, the controlling module 3, the mounting seat 4, the first electrode terminal 5, the second electrode terminal 6, the third electrode terminal 7, the first electrode connecting member 11 and the second electrode connecting member 12 are all mounted inside the battery sleeve 1A. In this embodiment, the first electrode connecting member 11 adopts an internal thread structure and is detachably mounted on the atomizer assembly. In another embodiment of the present, the first electrode connecting member 11 can also adopt an external thread structure.

While the embodiments of the present application are described with reference to the accompanying drawings above, the present application is not limited to the above-mentioned specific implementations. In fact, the above-mentioned specific implementations are intended to be exemplary not to be limiting. In the inspiration of the present application, those ordinary skills in the art can also make many modifications without breaking away from the subject of the present application and the protection scope of the claims. All these modifications belong to the protection of the present application.

What is claimed is:

1. An electronic cigarette, comprising an outer sleeve, a battery and a controlling module both mounted inside the outer sleeve, wherein the electronic cigarette further comprises a mounting seat which the controlling module is mounted on, and electrode terminals mounted on the mounting seat and electrically connected to the controlling module; ends of the electrode terminals away from the controlling module, are connected to conductive wires by soldering;

wherein the electrode terminals comprise a first electrode terminal, a second electrode terminal and a third electrode terminal, the conductive wires comprise a first conductive wire, a second conductive wire and a third conductive wire;

wherein the electronic cigarette further comprises a first electrode connecting member and a second electronic connecting member both mounted on an end of the outer sleeve, and the first electrode terminal and the second electrode terminal respectively mounted on the mounting seat and electrically connected to the controlling module; and wherein the controlling module is configured to control connection or disconnection between a first electrode of the battery and the first electrode connecting member or the second electrode connecting member.

2. The electronic cigarette according to claim 1, wherein the battery further includes a battery body and a second electrode; the first electrode and the second electrode are respectively defined on two opposite end surfaces of the battery body;

wherein an end of the first conductive wire away from the first electrode terminal is connected to the first electrode by soldering;

an end of the second conductive wire away from the second electrode terminal is respectively connected to the second electrode and the first electrode connecting member by soldering; and an end of the third conductive wire away from the third electrode terminal is connected to the second electrode connecting member by soldering.

3. The electronic cigarette according to claim 1, wherein the battery further includes a battery body and a second electrode; both the first electrode and the second electrode extend from an end surface of the battery body aloof from the first electrode connecting member to a side abutting the mounting seat;

wherein the first electrode terminal and the first electrode abut against each other; the second electrode terminal and the second electrode abut against each other; and both the second electrode terminal and the first electrode connecting member abut against an inner surface of the outer sleeve; and an end of the third conductive wire far away from the third electrode terminal is connected to the second electrode connecting member by soldering.

4. The electronic cigarette according to claim 3, wherein the first electrode terminal defines a first inserting cavity corresponding to the first electrode; the first electrode is inserted into the first inserting cavity; the second electrode terminal defines a second inserting cavity corresponding to the second electrode; the second electrode is inserted into the second inserting cavity.

5. The electronic cigarette according to claim 3, wherein the second electrode terminal defines a resisting part protruding towards an inner surface of the outer sleeve; the resisting part and the inner surface of the outer sleeve abut against each other.

6. The electronic cigarette according to claim 1, wherein the controlling module is detachably mounted on the mounting seat.

7. The electronic cigarette according to claim 1, wherein the controlling module includes a first pin, a second pin and a third pin; the mounting seat defines a first inserting hole, a second inserting hole and a third inserting hole;

wherein both the first pin and the first electrode terminal are inserted into the first inserting hole; both the second pin and the second electrode terminal are inserted into the second inserting hole; both the third pin and the third electrode terminal are inserted into the third inserting hole.

8. The electronic cigarette according to claim 7, wherein an end of the first electrode terminal located inside the first inserting hole defines a first inserting recess; the first inserting recess and the first pin abut against each other;

an end of the second electrode terminal located inside the second inserting hole defines a second inserting recess; the second inserting recess and the second pin abut against each other;

an end of the third electrode terminal located inside the third inserting hole defines a third inserting recess; the third inserting recess and the third pin abut against each other.

9. The electronic cigarette according to claim 1, wherein the electronic cigarette further comprises an insulating ring mounted between the first electrode connecting member and the second electrode connecting member and configured to achieve electrical insulation.

10. The electronic cigarette according to claim 1, wherein the electronic cigarette further comprises a lamp assembly; the lamp assembly is mounted on an end of the outer sleeve away from the first electrode connecting member.

11. The electronic cigarette according to claim 1, wherein the outer sleeve includes an atomizing sleeve and a battery sleeve detachably connected to the atomizing sleeve; an atomizer assembly of the electronic cigarette is mounted inside the atomizing sleeve; the battery, the controlling module, the mounting seat, the first electrode terminal, the second electrode terminal, the third electrode terminal, the first electrode connecting member and the second electrode connecting member are all mounted inside the battery sleeve.

* * * * *